United States Patent [19]

Foster

[11] Patent Number: 4,744,046

[45] Date of Patent: May 10, 1988

[54] VIDEO DISPLAY TERMINAL WITH PAGING AND SCROLLING

[75] Inventor: Mark J. Foster, Stevensville, Mich.

[73] Assignee: Zenith Electronics Corporation, Glenview, Ill.

[21] Appl. No.: 667,790

[22] Filed: Nov. 2, 1984

[51] Int. Cl.[4] ..... G06F 3/14

[52] U.S. Cl. ..... 364/900; 340/703; 340/735; 340/750

[58] Field of Search ..... 340/792, 799, 801, 723; 364/900 MS File, 200 MS File; 365/236

[56] References Cited

U.S. PATENT DOCUMENTS

| | | | |
|---|---|---|---|
| 3,737,860 | 6/1973 | Sporer | 364/200 |
| 4,118,773 | 10/1978 | Raguin et al. | 364/200 |
| 4,196,430 | 4/1980 | Denko | 340/799 |
| 4,204,206 | 5/1980 | Bakula et al. | 364/900 |
| 4,284,988 | 8/1981 | Seitz et al. | 340/792 |
| 4,342,991 | 8/1982 | Pope et al. | 340/792 |
| 4,375,638 | 3/1983 | O'Keefe et al. | 340/801 |
| 4,500,961 | 2/1985 | Engles | 364/200 |
| 4,528,648 | 7/1985 | Lew | 365/236 |
| 4,574,277 | 3/1986 | Krause et al. | 340/723 |
| 4,608,632 | 8/1986 | Kummer | 364/200 |
| 4,646,270 | 2/1987 | Voss | 365/236 |

OTHER PUBLICATIONS

J. T. Hanna et al., "Storage Paging Device for Microcontrollers", 10/76 IBM, Inc; Technical Disclosure Bulletin, vol. 19, No. 5.

*Primary Examiner*—Gareth D. Shaw
*Assistant Examiner*—Viet Q. Nguyen

[57] ABSTRACT

Paging and scrolling is provided in a video display terminal having a multi-page video memory by restricting memory access when in the scrolling mode to the page being displayed. An address pager functions as a multiplexer in coupling a central processing unit (CPU) and a cathode ray tube (CRT) controller to the video memory allowing the CPU to designate the mode of operation (paging or scrolling) and the page in memory to be addressed in the scrolling mode of operation, and permits the CRT controller to designate page as well as location to be addressed therein in the paging mode of operation. By limiting display access only to memory locations within a given page while in the scrolling mode, the overlapping and overwriting of adjacent pages of the video memory is avoided. Scrolling is performed by a "wrap-around" feature of each page of the video memory wherein the display information is sequentially displaced upward one horizontal scan line at a time with the erased first line in the video memory corresponding to the uppermost horizontal scan line used to update the bottom scan line with new video information. Paging is accomplished by the CRT controller designating the entire page to be displayed to the video memory. The traditional page addressing scheme may thus be returned to by providing a coded disable signal representing the paging mode of operation to the address pager without the contents of any pages erased or modified during a preceding scrolling operation.

8 Claims, 1 Drawing Sheet

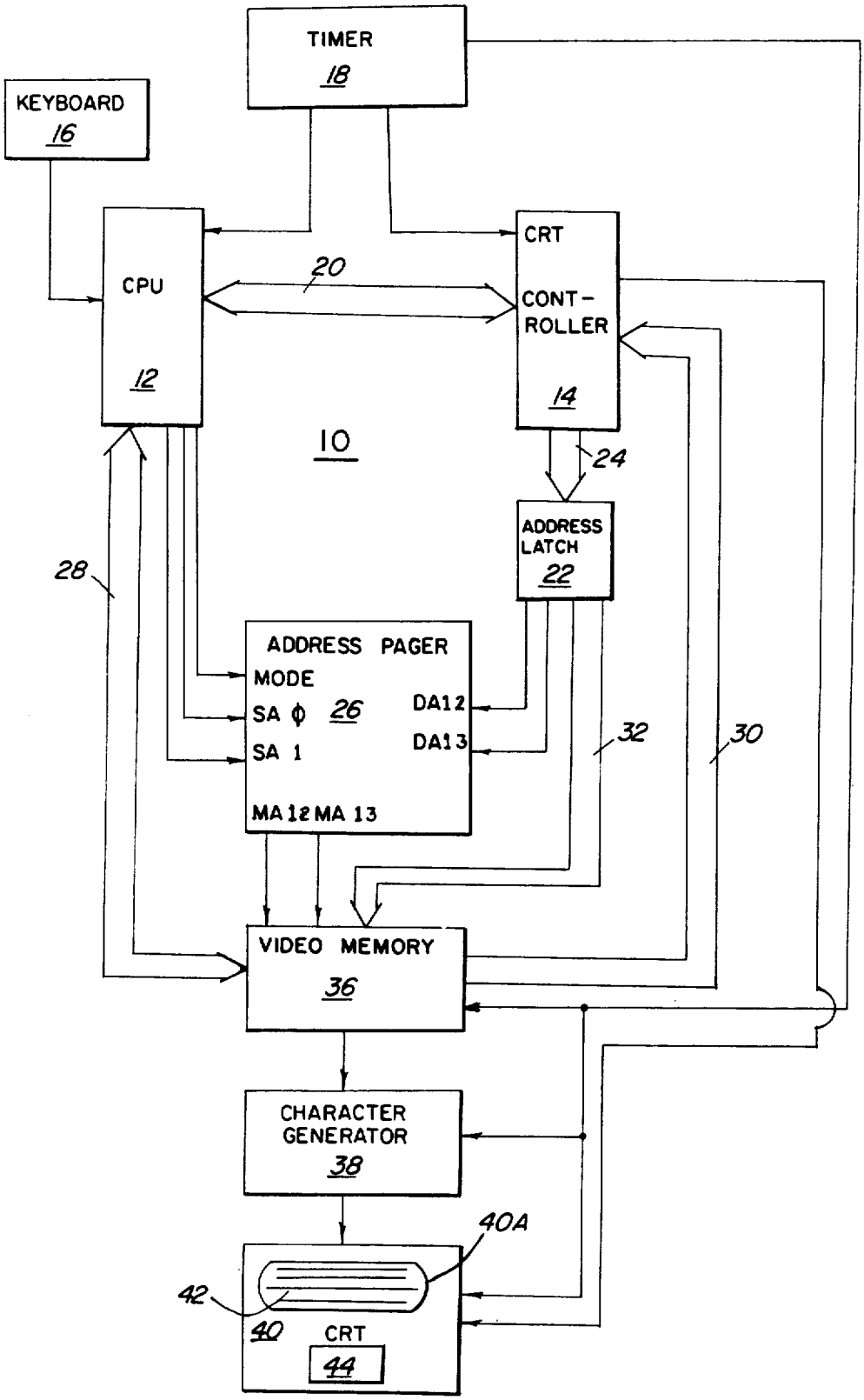
TIMER
18
KEYBOARD
16
CPU
12
20
CRT
CONT-
ROLLER
14
10
24
ADDRESS
LATCH
22
28
ADDRESS PAGER
MODE
SA ϕ
26
SA 1
DA12
DA13
MA12 MA 13
32
30
VIDEO MEMORY
36
CHARACTER
GENERATOR
38
40A
42
40
CRT
44

VIDEO DISPLAY TERMINAL WITH PAGING AND SCROLLING

BACKGROUND OF THE INVENTION

This invention relates generally to video display systems and is particularly directed to a scrolling and paging system in a raster-scanned video display terminal.

The most common type of video display terminal makes use of a raster-scanned display device such as a cathode ray tube (CRT) wherein an electron beam scans horizontally across the faceplate of the CRT on a line-by-line basis, progressing sequentially from the top of the faceplate to the bottom thereof. The electron beam is rapidly turned on and off which illuminates individual pixels, or dots, on the CRT's faceplate. Each alphanumeric character displayed is typically comprised of a generally rectangular matrix of pixels, e.g., 8 pixels high and 10 pixels across, which is sequentially scanned line-by-line from top to bottom by the electron beam. With the electron beam scanning across the CRT very rapidly, i.e., at a line frequency of 15,750 Hz, the resultant effect is a continuous, stable video display.

The video display terminal includes a video memory typically in the form of a random access memory (RAM) in which is stored display information. The video memory is typically sectioned into one or more "pages", each of which contains enough stored information to fill the CRT's faceplate. A single page of the video memory may include as many as 2,000 characters at any given time which represents the upper limit of the number of characters which can be displayed at one time on the CRT. Sometimes it is desirable to display more than the contents of a single page of the video memory and this has given rise to various arrangements for increasing the amount of information which can be presented on the video display terminal.

One approach, termed "scrolling", involves moving data on the video display upward or downward one line at a time, thus freeing a line of the display to provide more information. For example, in an upward scroll the top line of characters in the display is sequentially removed or erased, the remaining lines are moved up one line, and a new line of characters is inserted at the bottom of the display.

In contrast to this rolling of information off the CRT's screen as new information is presented, another approach, termed "paging", involves writing information to the video display until it is full. When the video display user is ready for more information, a signal is sent to the system controller, or central processing unit (CPU), typically by means of a user input device such as a keyboard. When this input signal is received, another page of information is read from the video memory and provided to the video display resulting in a complete "repainting" of the information on the video display.

In video display terminals having a paging capability, it is quite common to have multiple "pages" of video memory, each of which may contain enough information to completely fill the video display. Thus, memory capacity exceeds the display capacity of the display device. Those portions of the video memory not currently being displayed may contain additional information. For example, separate pages of stored information may be provided in the video memory for recall by the system user. Thus, the user may call up for display the contents of one or more pages of information in the video memory. An address latch is typically provided in such systems and is coupled between the video memory and a CRT controller to point to a selected area, or page, of memory. This address latch is used to select which portion of the video display memory will be displayed. Thus, whichever address the CRT controller provides to the address latch determines what portion of the display memory is displayed at the top of the CRT. In paging, the contents of the address latch are modified to point to the first line of a page stored in the video memory which the user wants to display.

On the other hand, in scrolling the address latch is not made to point to the next page, but rather is sequentially modified to point to the next line of the page in the video memory currently being displayed. Because the video display terminal's control logic always shows a fixed number of characters beginning at the address placed in the address latch, the entire display appears to be displaced upward line-by-line with a new line of information appearing at the bottom of the page in scrolling. If separate pages are immediately adjacent to one another in terms of memory locations utilized in the video memory, it is apparent that line-by-line scrolling will result in an overlapping of immediately adjacent memory pages. New information written at the bottom of the video display will overwrite information contained in the second area, or page, of the video memory. This is unacceptable where it is desired to maintain the integrity of individual pages for the purpose of displaying separate and distinct collections of information on the video display. It is for this reason that most raster-scanned video display terminals are incapable of supporting both scrolling and multiple pages.

The present invention is intended to overcome the aforementioned limitations of the prior art by providing a video display terminal capable of both paging and scrolling information presented thereon. Scrolling is accomplished by the sequential incrementing of the line addresses in the video memory with display access limited only to memory addresses within a given page in the video memory. This prevents overwriting of information in adjacent pages and maintains memory page integrity for paging operations when desired.

OBJECTS OF THE INVENTION

Accordingly, it is an object of the present invention to provide paging and scrolling in a raster-scanned video display terminal.

It is another object of the present invention to provide for line-by-line scrolling in a video display terminal having a multi-page video memory.

Yet another object of the present invention is to provide for paging and scrolling in a multi-page video display terminal by restricting memory page access when in the scrolling mode of operation.

A further object of the present invention is to provide for the mapping of the contents of a display memory without the transfer of blocks of data stored therein during the scrolling of information in a raster-scanned video display terminal.

BRIEF DESCRIPTION OF THE DRAWING

The appended claims set forth those novel features which characterize the invention. However, the invention itself, as well as further objects and advantages thereof, will best be understood by reference to the following detailed description of a preferred embodiment taken in conjunction with the accompanying FIG- URE wherein is shown a simplified block diagram of a video display terminal having both a scrolling and paging capability in accordance with the present invention.

DETAILED DESCRIPTION OF THE PREFERRED EMBODIMENT

Referring to the FIGURE, there is shown in simplified block diagram form a video display terminal 10 with paging and scrolling in accordance with the present invention.

The video display terminal 10 includes a central processing unit (CPU) 12 to which user initiated inputs are provided by means of a conventional input device such as a keyboard 16. The video display terminal 10 may be used in performing any of the more conventional terminal operations such as word processing or computer graphics. The CPU 12 utilized in a preferred embodiment of the present invention is the 8-bit HMOS 8088 microprocessor available from Intel Corporation of Santa Clara, Calif. However, the present invention is not limited in its application to the use of this particular microprocessor, but will operate equally well with any conventional microprocessor.

The CPU 12 is coupled to a video memory 36 via a data/address bus 28. The data/address bus 28 is bidirectional and permits the CPU 12 to either write data into or read data from the video memory 36. In addition, the CPU 12 is coupled to an address pager 26 via MODE, SA$\phi$ and SA1 lines. The address pager 26 is further coupled to the video memory 36 via MA12 and MA13 lines. The MODE SA$\phi$ and SA1 lines permit the CPU 12 to write system control commands to the video memory 36 via the address pager 26 as described in detail below.

The CPU 12 is further coupled to a cathode ray tube (CRT) controller 14 by means of a CPU control address/data bus 20. The CRT controlled 14 is further coupled to the video memory 36 via a first address/control bus 24, an address latch 22, and a second address-/control bus 32. In addition, the CRT controller 14 is coupled directly to the video memory 36 via a data bus 30. Unlike the CPU 12, the CRT controller 14 is only capable of providing addresses to the video memory 36 via the first address/control bus 24, address latch 22, and the second address/control bus 32. The video information stored in the video memory 36 is read therefrom by the CRT controller 14 via the data bus 30.

In general, the video memory 36 stores all of the bit-patterns to be displayed via the CRT controller 14 on a cathode ray tube (CRT) 40. The video memory 36 is coupled to the CRT 40 by means of a character generator 38. The character generator 38 is typically ba read only memory (ROM) which contains information corresponding to a character to be displayed on the CRT 40. The character generator 38 has the capacity for storing the dot matrix configuration for a given number of characters and symbols. The character generator 38 thus provides the desired dot matrix configuration for the formation of an individual character to the CRT 40, with individual bits shifted therein under the control of a dot clock signal provided from the system clock, or timer, 18. The timer 18, which is coupled to various elements of the video display terminal 10 as shown in the FIGURE, provides for the coordination and synchronization of the display of video information read from the character generator 38 with the electron beam scanning of the faceplate 40A of the CRT 40.

The CRT 20 is conventional in design and includes processing circuitry 44 for receiving vertical and horizontal sync timing signals as well as video signals from the CRT controller 14 for controlling an electron beam 42 within the CRT 40. The electron beam 42 is directed upon the CRT's faceplace 40A which is coated with a phosphor, or a similar light-emitting substance, in the form of individual pixels which glow when struck by the electron beam 42. It is in this manner that a video image is formed on the faceplate 40A of the CRT 40.

Some of the bit patterns stored in the video memory 36 represent character images, whereas others may represent graphic images. The CPU 12 determines which patterns are to be displayed on the CRT 40 and modifies the video memory 36 to appropriately reflect these patterns. The various bit patterns may result from external data generated by a device such as the keyboard 16 or may be internally generated alphanumeric data generated by an operating program stored in the CPU 12. In the text mode of operation, the video memory contains individual characters which are converted to dot patterns by the character generator 38. Thus, a single byte in the video memory 36 represents eight scan lines, or 64 pixels, on the faceplate 40A of the CRT 40. The display memory contained in the video memory 36 is then sequentially accessed by using addresses provided by the CRT controller 14 and the digital patterns read from the video memory 36 are converted into corresponding video signals representative of the selected character patterns by the character generator 38 in driving the CRT 40.

Thus, the video memory 36 is comprised of a plurality of bytes, each of which represents 64 pixels on the CRT's screen 40A. To display a character, the appropriate byte in the video memory 36 must be modified. The address of this byte is provided from the CPU 12 to the video memory 36 via the data address bus 28.

The CRT controller 14 utilized in a preferred embodiment of the present invention is the 6845 CRT controller available from a number of sources. The CRT controller 14 generates the signals necessary to interface the digital system comprised primarily of the CPU 12 and the video memory 36 to the raster scanned CRT 40. The CRT controller 14 continuously updates the CRT's screen 40A 60 times per second (or 50 times per second in some parts of the world) based upon the contents of the locations addressed within the video memory 36. The CRT controller 14 generates a video RAM address signal which it provides to the video memory 36 via the first address/control bus 24, the address latch 22, and the second address/control bus 32. The CRT controller 14 then reads a byte representing 64 pixels on the CRT's screen from the video memory 36 via the data bus 30. Once the characters are displayed, the CRT controller 14 automatically, depending upon its initialization parameters, advances to the next byte containing another character with this process continuing without interruption.

The control/data signals transmitted via the CPU control address/data bus 20 from the CPU 12 to the CRT controller 14 specify such system parameters as CRT type, lines per screen to be displayed on the CRT, characters per line, and the vertical sync interval. From the FIGURE, it can be seen that control and data signals are provided between the video memory 36 and both the CPU 12 and the CRT controller 14.

The CRT controller 14 includes various components for interfacing the CPU 12 and the video memory 36 with the CRT 40. Included in the CRT controller, although not shown in the FIGURE, are vertical and horizontal sync generators which are coupled to the system timer 18 and responsive to timed outputs therefrom for respectively providing vertical and horizontal sync pulses to vertical and horizontal deflection circuitry within the processing circuitry 44 of the CRT 40 for driving the electron beam 42. The sync pulses ensure proper timing between the video information displayed and the position of the electron beam 42 on the CRT's faceplate 40A. Thus, the vertical and horizontal sync generators function as counters in counting the received clock signals from the timer 18 and periodically providing vertical and horizontal sync pulses to the CRT 40. The vertical rate of the CRT is typically 60 Hz, while the horizontal rate is typically 15,750 Hz. These numbers respectively represent the vertical and horizontal sweep rates of the electron beam across the CRT's faceplate 40A.

In a typical video display terminal as many as 2000 characters may be displayed at any given time. This is shown in TABLE I which is a simplified illustration of the organization of a multi-page video memory 36.

TABLE I

| | |
|---|---|
| ∅ | This is the first page of the video memory. It is not being displayed. |
| 2000 | |
| 2100 | This is the first line being displayed. |
| 2200 | This is the second line being displayed. |
| . | |
| . | |
| . | |
| 4000 | This is the last line being displayed. |
| 4100 | This is the first line of the third page. |
| 4200 | This is the second line of the third page. |
| . | |
| . | |
| . | |
| 6000 | This is the last line of the third page. |
| 6100 | Last page of video memory. |
| 8000 | |

The organization of the video memory shown in TABLE I includes four pages wherein the second page which includes characters 2100 to 4000 is being displayed. Thus, the first page comprised of characters numbered 0–2000 is not being displayed and may be used for other purposes. Similarly, the third and fourth pages respectively comprised of characters 4100–6000 and 6100–8000 are not being presented on the CRT 40. Each line of the video display typically contains as many as 100 characters and thus the addresses of successive lines on the video display are incremented by 100. For example, the first line being displayed on the CRT 40 begins with address 2100, while the second line thereof begins with address 2200. This continues to the last displayed line which begins with address 4000 and extends to an address of 4090. In the present example, each character is 10 bits wide corresponding to a character width of 10 pixels. It should be noted here that while each line is disclosed as containing 100 characters, this is done merely for the sake of clarity and does not represent a limitation of the present invention as virtually any number of characters per line could be used in the present invention.

Scrolling in a conventional video display terminal is accomplished by incrementing the starting address of the display by 1 character scan line during each successive sweep of the CRT's faceplate 40A by the electron beam 42. For example, information displayed on the top of the CRT 40 may begin with line 2100 and end with line 4000, which represents a display of the entire contents of the second page. In scrolling the displayed information upward, the next sequential display of information will begin with address 2200 and end with address 4100 as shown in the area between the dotted line in the table. From this it can be seen that a conventional prior art scrolling operation involves an overwriting of information contained in the third page of the video memory 36 and a loss of this information. This may be undesirable particularly where it is necessary to later recall the contents of the third page such as by a paging operation wherein the entire contents of either the second or third page may be separately displayed as desired. The present invention avoids this conflict between scrolling and paging by preventing CRT inadvertent controller access to the third page of the video memory 36. This is accomplished in the following manner.

The addresses of the various pages and lines thereof in the video memory 36 are indicated as round numbers in the table. However, in a typical video display terminal binary addressing is employed such that a plurality of address lines are used by the CPU 12 and the CRT controller 14 for accessing the various memory locations within the video memory 36. Each of these address lines which are included in the data/address bus 28 and the first and second address/control buses 24 and 32 may be either ON or OFF. Combinations of multiple address lines are used in concert to address the video memory 36, with a typical system using approximately 14 address lines to uniquely specify a character located wihin the video memory 36. For example, the system shown here has as many as 16,384, or $2^{14}$, characters stored in the video memory 36. Video memory addresses are therefore specified as a binary number from 0 to 16,383. Because of the binary nature of video display terminals, the number of pages in the video memory is always a power of 2. In the present example, the video memory 36 includes four pages, or distinct areas, of memory with each of the pages containing ¼ of the total display memory. Thus, each page is capable of containing as many as 16,384 divided by 4, or 4,096, characters. In addition, since four pages are available within the video memory 36, two address lines coupled thereto must be used to uniquely specify a particular page. This is because each address line has two combinations and two address lines times two combinations yield a total of four combinations representing the four pages of the video memory 36. With two address lines used to specify a page number, the remaining 12 lines of the total of 14 address lines are available for selecting one of the 4096 character positions associated with each page of the video memory 36.

The address latch 22 is normally set by the CRT controller 14 to the first character to be displayed. Video control logic (not shown) within the CRT controller 14 then causes the following characters to be displayed in sequence. In a typical video display terminal, the address latch 22 contains all of the bits used to address a particular page within the video memory 36. Thus there are normally 14 bits of memory in the address latch 22 for addressing the various locations within the video memory 36. In the present invention, the address latch has 14 address outputs, with two of the outputs routed to the address pager 26. These two outputs of the address latch 22 to the address pager 26 are shown as the DA12 and DA13 inputs thereto and represent the two most significant bits of an address within the video memory 36. These two lines are controlled by the CPU 12 which provides appropriate information via the CPU control address/data bus 20 to the CRT controller 14. The remaining 12 DA (Display Address) lines are included in the second address/control bus 32.

The CPU 12 provides three inputs to the address pager 26 in controlling the operation of the video display terminal 10. These three inputs are the MODE and SAϕ and SA1 (System Address) signals. The MODE input to the address pager 25 indicates which mode, scrolling or paging, the video display terminal 10 is in. The mode may be selected by a user with an appropriate input provided to the CPU 12 via the keyboard 16. The mode signal provided to the address pager 26 determines whether the SAϕ, SA1 or DA12, DA13 inputs will be provided to the video memory 36. When in the paging mode of operation, the SAϕ SA1 and inputs from the CPU 12 to the address pager 26 are then provided to the MA (Memory Address) outputs therefrom and are used to represent the page to be addressed by the address input from the CRT controller 14 and the address latch 22. With two inputs used to designate the page to be displayed, as many as 4 ($2^2$) individual pages within the video memory 36 may be selectively accessed. Thus, in this mode of operation regardless of what address is requested by the address latch, the MA lines which actually communicate with the video memory 36 will cause information from the selected page to be displayed.

In exercising control over the video display terminal 10, the CPU 12 initially selects a particular value for the MODE input to the address pager 26 to indicate whether the scrolling or paging mode of operation is to be used. If scrolling is to be used, the MODE line is set so that two of the DA address lines, the DA12 and DA13 lines, from the address latch 22 are routed to the MA address lines provided to the video memory 36 from the address pager 26. This connection is typical for the scrolling mode in most video display terminals in that the address lines coming from the address latch 22 are directly coupled to the video memory 36. If the paging mode is desired, the CPU 12 sets the MODE input to the address pager 26 such that the SA address lines are coupled to the MA address lines. Next, the CPU 12 sets the SA lines to correspond to one of the pages, or areas, within the video memory 36. Since the MA12 and MA13 address bits uniquely specify a page within the video memory 36, regardless of what address is provided by the address latch 22 to the address pager 26, the MA lines which actually communicate with the video memory 36 will always access information from the page designated by the SAϕ and SA1 inputs from the CPU 12. For example, if a binary 2 is selected on the SA address lines for the CPU 12 to the address pager 26, the contents of the second page of the video memory 36 will be displayed on the CRT 40 with the specific addresses accessed in the second page designated by the display address inputs from the address latch 22 to the address pager 26 via the remaining (DAϕ through DA11) display address lines thereto. It is in this manner that access to the various pages within the video memory 36 is restricted in the scrolling mode of operation in order to prevent an overlapping between adjacent pages while scrolling and an overwriting and erasure of information stored therein.

There has thus been shown a video display terminal having a multi-page video memory capable of performing line-by-line scrolling as well as displaying the contents of the various pages thereof. In the scrolling mode of operation, memory addressing is restricted to a designated page in preventing the overlapping and overwriting of data in adjacent pages in the video memory. In the paging mode of operation the entire contents of any of the pages may be displayed as desired.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. In a video display terminal having a multi-page video memory wherein data are stored in addressable locations in a plurality of immediately adjacent pages in said video memory for presentation on a video display, a paging and scrolling system for displacing the displayed contents of entire selected pages in a first mode of operation and for displacing line-by-line the displayed contents of a selected one of said adjacent pages in said video memory in a second mode of operation, said system comprising:

processing means responsive to user-initiated inputs for generating a mode control signal and a first video memory page select address representing a selected one of said adjacent pages in the video memory;

control means coupled to said processing means for generating a second video memory page select address and video RAM addresses respectively representing one of said immediately adjacent pages in the video memory and a plurality of sequentially ordered video memory addresses within said immediately adjacent pages;

address latch means coupled to said control means and to said video memory for providing said video RAM addresses to said video memory and for outputting said second video page select address; and address pager means connecting said processing means and said address latch means to the video memory and responsive to said mode control signal for providing said first video memory page select address and said video RAM addresses to the video memory in said first mode of operation and for providing said second video memory page select address and said video RAM addresses to the video memory in said second mode of operation, wherein said selected one of said adjacent pages of the video memory wraps around itself in said second scrolling mode of operation.

2. The system of claim 1 further comprising user-responsive input means coupled to said processing means for providing user input commands thereto.

3. The system of claim 2 wherein said user-responsive input means comprises a keyboard.

4. The system of claim 1 further comprising a plurality of system address lines for connecting said processing means and said address pager means for addressing said selected one of said adjacent pages in the video memory.

5. The system of claim 1 further comprising a plurality of display address lines connecting said address latch means to said address pager means for addressing a plurality of pages in the video memory.

6. The system of claim 1 further comprising an address bus connecting said address pager means to the video memory, said address bus including a plurality of memory address lines for addressing a plurality of pages in the video memory.

7. The system of claim 1 wherein the video display is a raster-scanned cathode ray tube and said control means comprises a cathode ray tube controller.

8. The system of claim 1 wherein said address pager means comprises a multiplexer circuit.

* * * * *